US007069123B2

(12) United States Patent
Lapointe

(10) Patent No.: US 7,069,123 B2
(45) Date of Patent: Jun. 27, 2006

(54) ADAPTIVE ALGORITHM FOR LOCATING NETWORK DEVICES IN AN ECP BRAKE-EQUIPPED TRAIN

(75) Inventor: Christopher Lapointe, Dexter, NY (US)

(73) Assignee: New York Air Brake Corporation, Watertown, NY (US)

( * ) Notice: Subject to any disclaimer, the term of this patent is extended or adjusted under 35 U.S.C. 154(b) by 314 days.

(21) Appl. No.: 10/704,607

(22) Filed: Nov. 12, 2003

(65) Prior Publication Data

US 2005/0102071 A1 May 12, 2005

(51) Int. Cl.
*G01D 1/00* (2006.01)

(52) U.S. Cl. ..... 701/19; 701/20; 701/66; 246/108; 246/110

(58) Field of Classification Search ..... 701/19, 701/20, 66; 246/108, 110, 1 C
See application file for complete search history.

(56) References Cited

U.S. PATENT DOCUMENTS

| | | | | |
|---|---|---|---|---|
| 4,041,470 | A | 8/1977 | Slane et al. | 701/35 |
| 4,689,602 | A | 8/1987 | Morihara et al. | 340/438 |
| 4,702,291 | A | 10/1987 | Engle | 105/35 |
| 4,825,189 | A | 4/1989 | Honma et al. | 246/166.1 |
| 5,168,273 | A | 12/1992 | Solomon | 340/870.05 |
| 5,265,832 | A | 11/1993 | Wesling et al. | 246/169 R |
| 5,530,328 | A | 6/1996 | Fernandez et al. | 318/370 |
| 5,777,547 | A | 7/1998 | Waldrop | 340/438 |
| 5,815,823 | A | 9/1998 | Engle | 701/19 |
| 5,967,465 | A | 10/1999 | Lumbis et al. | 246/187 C |
| 6,225,919 | B1 | 5/2001 | Lumbis et al. | 340/933 |
| 2003/0151520 | A1 * | 8/2003 | Kraeling et al. | 340/825.72 |

OTHER PUBLICATIONS

Anderson, G. B. and Moody, H. G., "Locomotive and car control: A breakthrough in trainline communications?," Railway Age (Aug. 1995).

*Intra-Train Communication Specification for Cable-Based Freight Train Control Systems*, Specification S-4230-00, Nov. 15, 1999 (Rev. Feb. 27, 2002).

* cited by examiner

*Primary Examiner*—Gertrude A. Jeanglaude
(74) *Attorney, Agent, or Firm*—Barnes & Thornburg LLP

(57) ABSTRACT

A method of locating nodes in train having at least one node per car and includes enabling each node; querying each enabled node to respond during a response interval; disabling each node which responded; and re-querying the enabled nodes until no further responses are received during a response interval. The method further includes disabling the responding nodes before the expiration of the response interval if the interval is under utilized and after the expiration of the response interval if the interval is fully utilized. The method further includes determining the number of responses during a present response interval and setting the length of a subsequent response interval as a function of the determined number of responses. The number of responses may be determined for a whole interval or for a portion of the present response interval, and the length of the subsequent response interval is set based on the response rate determined for the portion of the present response interval. The subsequent response interval may be initiated before the expiration of the present response interval if a new interval length is to be set.

24 Claims, 7 Drawing Sheets

ADAPTIVE ALGORITHM FOR LOCATING NETWORK DEVICES IN AN ECP BRAKE-EQUIPPED TRAIN

BACKGROUND AND SUMMARY OF THE INVENTION

The present invention relates generally to management of electrically-controlled pneumatic (ECP) trains and, more specifically, to the location and identification of nodes on the train network.

ECP brake systems consist of a network of ECP devices or nodes. The number of devices or nodes on the network varies. A controlling node must be able to locate and retrieve information from every device or node on the network. A general representation of network 10 is shown in FIG. 1 to include the controlling node or device 12 and nodes or devices 14 connected by buss 16 which may be wire or wireless.

The American Association of Railroads (AAR) Intra-Train Communication Specification for Cable-Based Train Control Systems (S-4230) specifies a message for locating network devices. The message contains both a command to enable or disable receiving devices' responses or to query receiving devices to respond and a settable response interval over which receiving devices are to randomize their responses. Section 4.2.1 of the AAR Specification is shown in the Appendix. In the Appendix, HEUs are head end units or locomotives, CCDs are the brake control devices on the cars, PSCs are the power source controllers on the locomotives and EOT is the end of train device.

Typically an "enable response" message is broadcast to all devices on the network by the controlling device. It then broadcasts a query for all devices to respond. All devices which are enabled send a response. For each response, the controlling device normally receives multiple responses per query. It then unicasts a "disable response" command to the responder. The query/receive/disable cycle is repeated until no more responses are received. A flow chart of this process is shown in FIG. 2.

With multiple network devices, there is potential for the network to be overloaded with traffic and for contention problems to arise. The response interval may be used to mitigate this by spreading out responses over a specified interval. The ECP network used has a relatively low bandwidth, and is capable of handling a maximum of approximately 10–12 messages per second. Thus, a system with 500 nodes would require a 50 second response interval. In theory, all of the devices spread their responses over this interval, and the number of nodes attempting to send a response during any given time slice should be constant over the response interval. However, with no prior knowledge of the number of nodes which will respond, choosing an interval is problematic. Too small an interval for the number of responders will cause network contention, while too large an interval will be highly inefficient. This is compounded by the necessity of repeating the query phase until no responses are received to ensure all devices have been located.

A method of identifying power source nodes in the network is described in U.S. Pat. No. 6,225,919. Following the identification process, serialization (or the order of the nodes in the train) is determined using one of the methods of U.S. Pat. Nos. 5,966,084 and 6,160,619.

The present invention is a method of locating nodes in train having at least one node per car and includes enabling each node; querying each enabled node to respond during a response interval; disabling each node which responded; and re-querying the enabled nodes until no further responses are received during a response interval. The method further includes determining the number of responses during a present response interval and setting the length of a subsequent response interval as a function of the determined number of responses. The number of responses may be determined for a whole interval or for a portion of the present response interval, and the length of the subsequent response interval is set based on the response rate determined for the whole or portion of the present response interval. The subsequent response interval may be initiated before the expiration of the present response interval if a new interval length is to be set.

The method may further include determining if a response has not been received before expiration of a wait period between responses and performing the determining of the number of responses and setting the interval length if the wait period has expired. The setting of the interval length may be performed after expiration of either one or both of the wait period and the response interval. The disabling may be performed after the expiration of one or both of the wait period and the response interval or before the expiration of the response interval.

An initial response interval length may be set based on the anticipated number of active nodes and anticipated response rate. The number of active nodes that have not responded may be estimated, and the length of the subsequent interval is set as a function of the number of active nodes that have not responded. The rate of response is determined, and the length of the subsequent interval is set as a function of both the number of active nodes that have not responded and the determined response rate.

The method may also be enabling each node; querying each enabled node to respond during a response interval; disabling each node which responded after expiration of the response interval; and re-querying the enabled nodes during subsequent response intervals until no further responses are received during a response interval. Alternatively the method may be enabling each node; querying each enabled node to respond during a response interval; determining if a response has not been received before expiration of a wait period between responses; disabling each node which responded before expiration of the response interval if it has been determined that a response has not been received before the wait period has expired; and re-querying the enabled nodes during subsequent response intervals until no further responses are received during a response interval. Either of these methods may be used alone or with the method of changing the length of the response interval.

Other advantages and novel features of the present invention will become apparent from the following detailed description of the invention when considered in conjunction with the accompanying drawings.

DETAILED DESCRIPTION OF THE PREFERRED EMBODIMENTS

Figure 1:
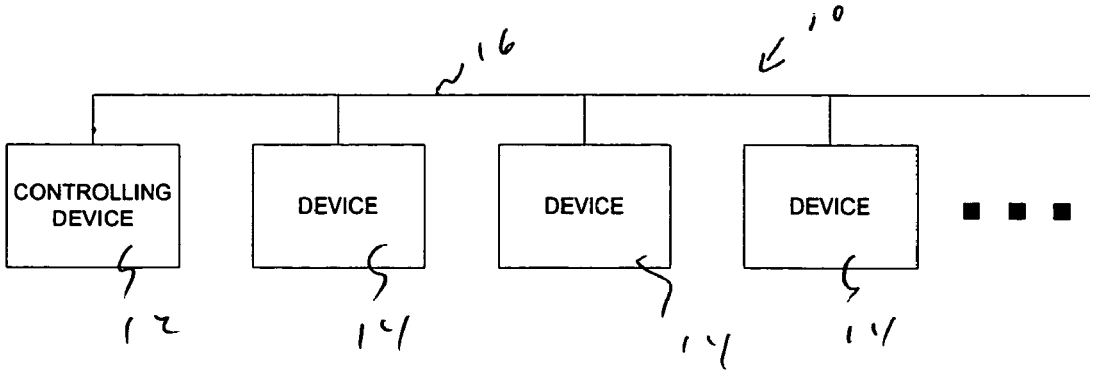
FIG. 1 is a block diagram of a network.

An ECP train consisting of one or more locomotives and a plurality of cars each having one or more nodes or devices in the network 10 of FIG. 1. The controlling device 12 in the train network is the head end unit HEU. The other nodes or devices 14 may be the brake control devices CCDs on the cars, the power source controllers PSCs on the locomotives and the end of train device EOT. The network 10 includes buss 14.

Figure 2:
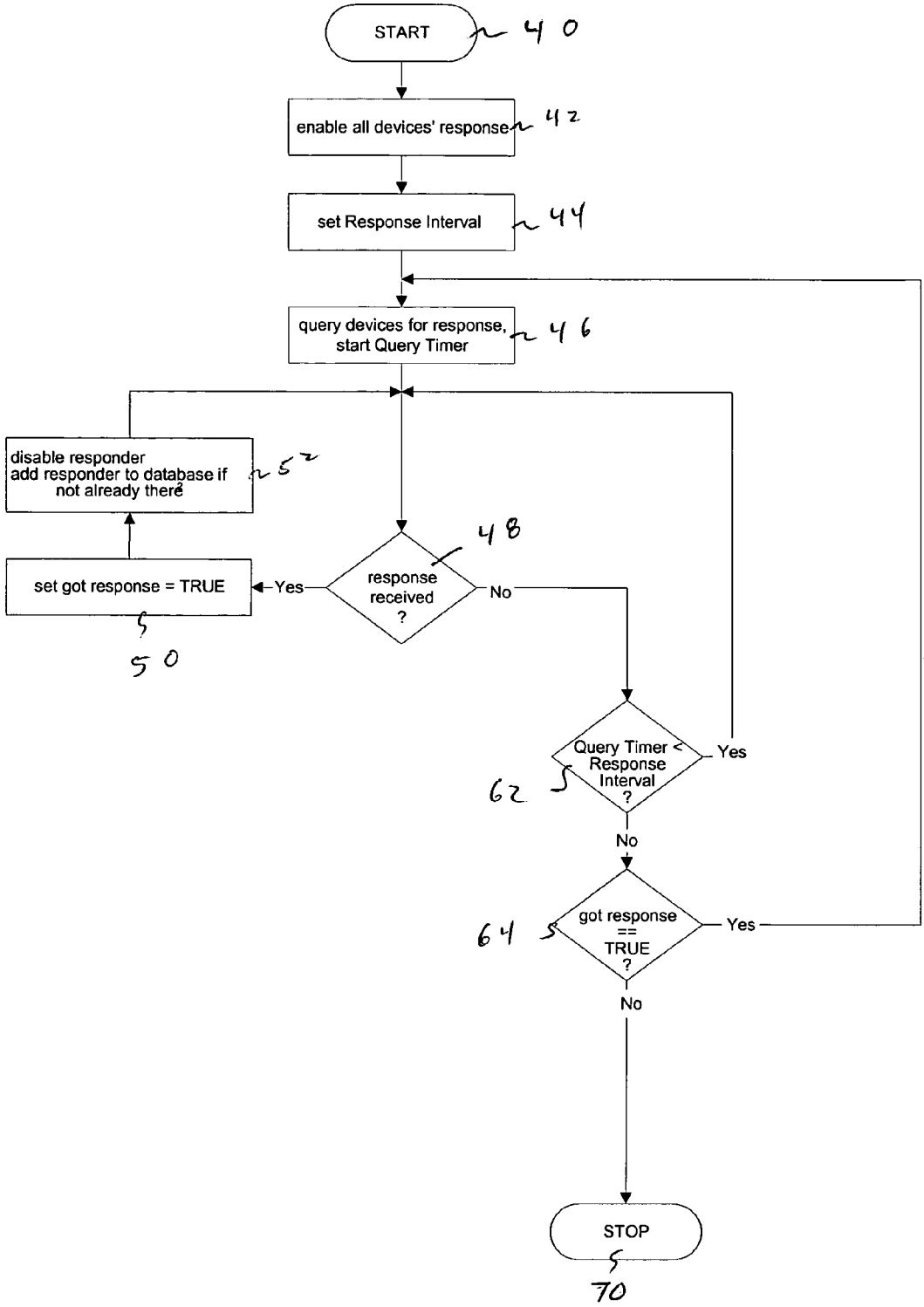
Figure 2 PRIOR ART
FIG. 2 is a flow chart showing one method of identifying the nodes of the ECP network according to the prior art.

The method of locating and identifying nodes in the train of the prior art, as illustrated in FIG. 2, begins at start 40. Enabling devices responsive to an inquiry at 42 is performed by sending a control query message, according to the appendix, with the command bid set to zero or unlock. Next, there is setting a response interval at 44. The initial length setting for the response interval in seconds is based on the expectation of the largest number of devices possible on the network and the average rate at which the responses are to appear on the network. For example, to handle a possible 500 devices with an average response rate of 10 responses per second, the calculation is as follows: Interval=(50 responses)/(10 responses per second)=50 seconds.

Next, the devices are queried for responses at 46 by sending a query signal with the command bid set to two or sent device information. Also, a query timer is started. A determination is made at 48 regarding whether a response has been received. If a response has been received YES, it is set to "TRUE" at 50. Also the responder is disabled and added to the data base if not already in the data base at 52. Next, the process goes back to determining whether a response has been received at 48.

If a determination is made at 48 that a new response has not been received NO, then there is a determination at 62 whether the present query timer is less than the response interval or whether the response interval has not expired. If not expired Yes, the process goes back to determining whether a response has been received at 48. If the response interval has expired NO, there is a determination at 64 of whether a "TRUE" response has been received in the response interval at all. If it has YES, the process goes back to 46 and re-queries the devices for a response and starts the query timer for a new response interval of the same duration or length. If not NO, the process is stopped at 70. The decisions at 62 and 64 basically determine that there are no active or unlocked devices or nodes that have responded to the present response interval.

Figure 3:
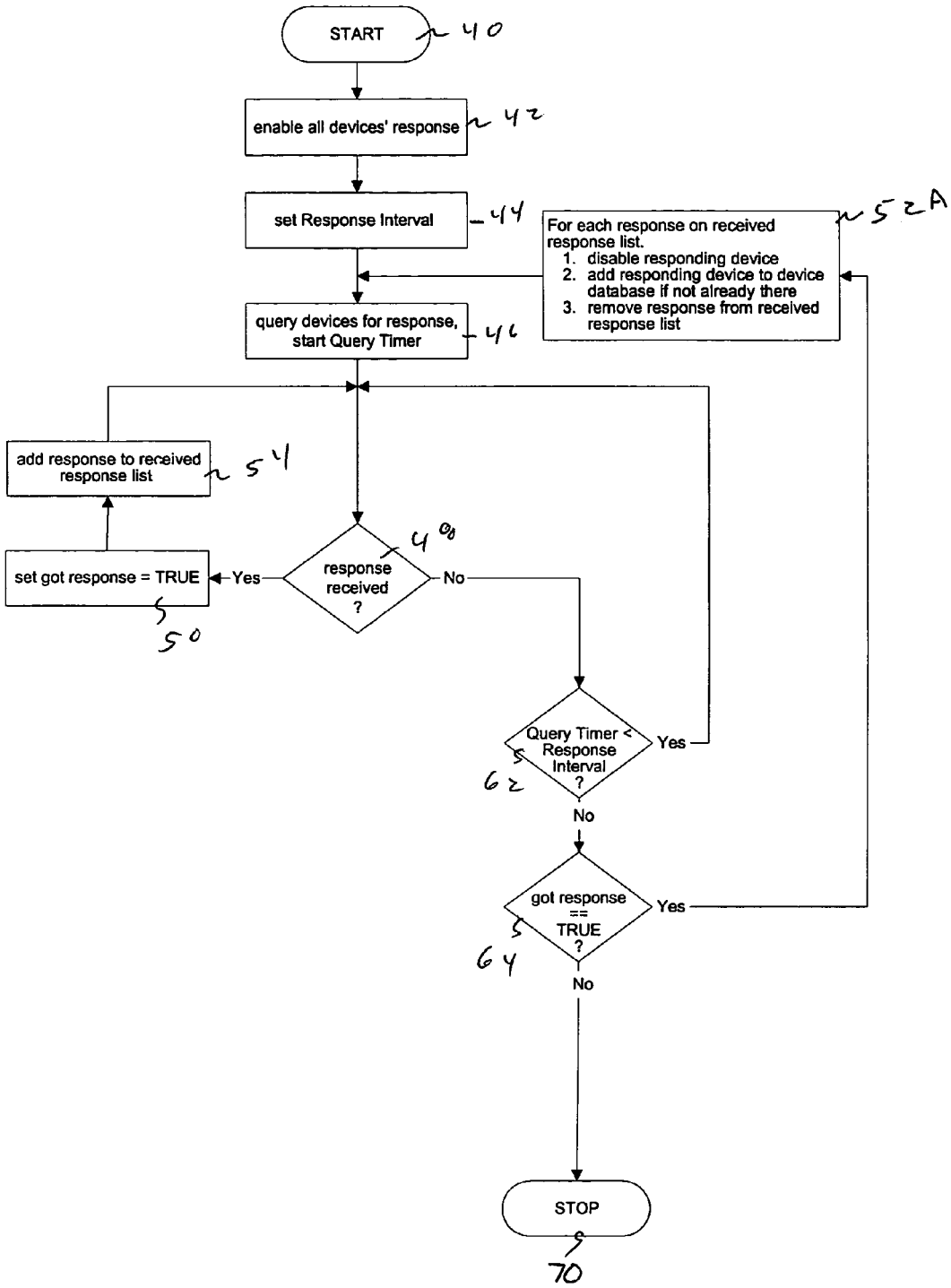
FIG. 3 is a flow chart showing an embodiment of a method of identifying the nodes of the ECP network according to the principles of the present invention.
Figure 5:
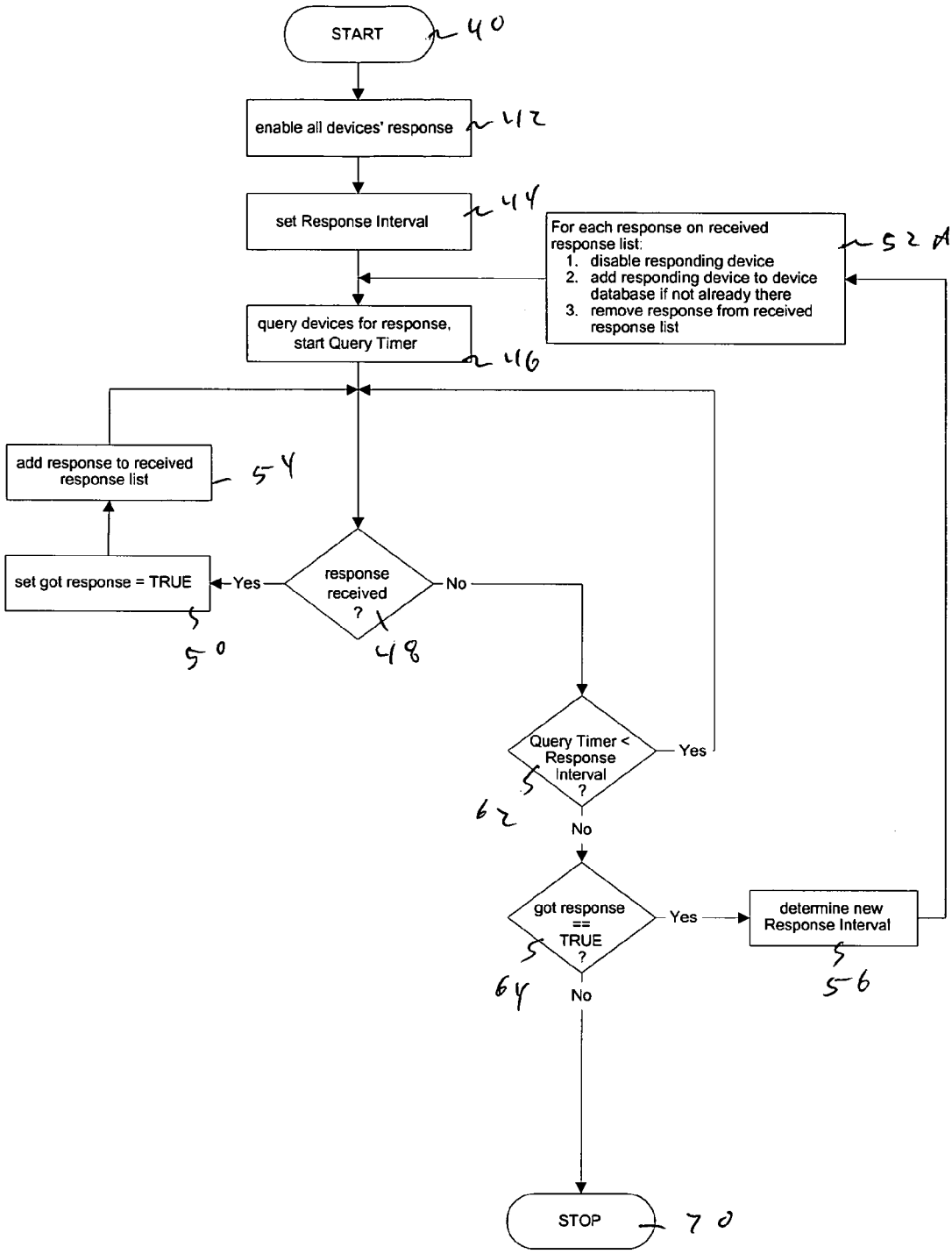
FIG. 5 is a flow chart showing another embodiment combining the methods of FIGS. 3 and 4 according to the principles of the present invention.

As a first improvement to the process of FIG. 1, the resetting of the responder or responding devices is performed when the devices are not responding. This may be after the response interval has expired as shown in FIGS. 3 and 5 or during or after expiration of the response interval when no response has been received in a wait period as show in FIGS. 6 and 7. In each of these figures, the operations of 52 of FIG. 2 are modified and performed in a different part of the flow chart and are show as 52A.

Referring to FIG. 3, if the response has been received YES as determined at 48, the response is set TRUE at 50 and the responder is added to a received response list at 54. The process then returns to determining if a response has been received at 48. If a response has not been received NO as determined at 48, the response interval has expired as determined NO at 62 and the response was TRUE as determined at 64, then the responding devices are disabled at 52A. Also at 52A, the responding devices are removed from the received response list and added to the device data base if not already on the data base. Next, the process goes back to 46 and re-queries the devices for a response and starts the query timer for a new response interval of the same duration or length.

Thus in FIG. 3, the resetting of the responding devices is performed after the expiration of the response interval and before initiation of a new response interval or at least before receipt of any responses in the new response interval. Simply queuing a response at this time at 54, instead of immediately disabling the respondent, decreases network traffic and allows a maximum number of responses to be received during the current response interval.

At 52A for each response on the received responses list, a disabled responding signal is sent wherein the command is set to one or lock. The responding device from the list is added to the device data base if it is not already there. The response is removed from the received response list from 54. This actions at 52A handle the possibility that a device may miss its disability or lock and response to a later inquiry. Another disabled command is sent, and the device or node is not added to the device data base.

The locking information is sent unicast to the individual, identified node, whereas the queries and unlocking are done in a broadcast mode. Also, please note that the zero time interval is equivalent to responding to immediate interval.

Figure 4:
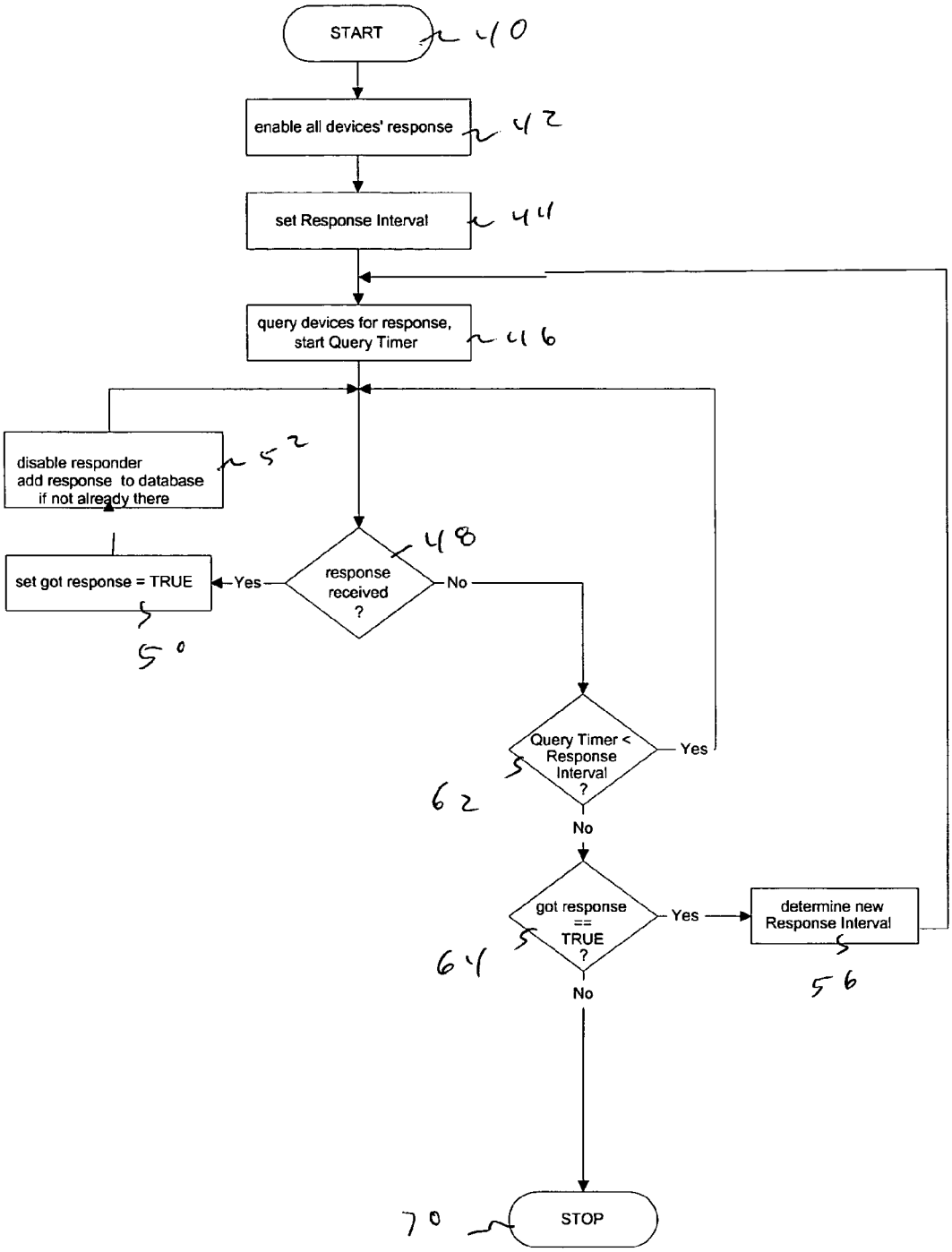
FIG. 4 is a flow chart showing another embodiment of a method of identifying the nodes of the ECP network according to the principles of the present invention.

A second embodiment is illustrated in FIG. 4. Instead of controlling the time or place in the sequence that the devices are disabled, the response interval is adjusted based on needed capacity. As in the prior art of FIG. 2, if a response has been received YES at 48, it is set true at 50, disabled and added to data base at 52 and cycle back to 48. If a response has not been received NO at 48 and the query timer is less than the response interval Yes at 62, the process cycles back to 48. If the determination at 62 is that the query timer is not less than the response interval NO, a determination is made at 64 if the response received was TRUE. If it was TRUE, Yes, a determination of whether a new response interval of the same or different duration is required at 56. The same or new response interval is then set and the process cycles back to 46. As in FIG. 2, if the determination at 64 is NO, thr process stops at 70.

The determination at 56 of whether a new response interval is necessary generally includes determining whether the capacity of the present interval is being fully used or not. If it is being fully used, then a subsequent interval may be set at the same or slightly lower length. If it is not being used, then the interval period may be reduced. To determine whether the capacity is being used, a determination is made of the number of responses being received during the present response interval. This determination may also be made over a portion of the interval, and an estimate is made of the response rate or the capacity of the remainder of the interval to handle the response rate. (see FIG. 6).

Another embodiment that is a combination of the embodiments of FIGS. 3 and 4 is shown in FIG. 5. It includes not disabling the responding devices until there is a pause in the response interval or after the response interval and modifying the response interval duration as a function of the required capacity. Thus, block 52A replaces block 52, and blocks 54 and 56 are added. The operation is as described in FIGS. 3 and 4.

Figure 6:
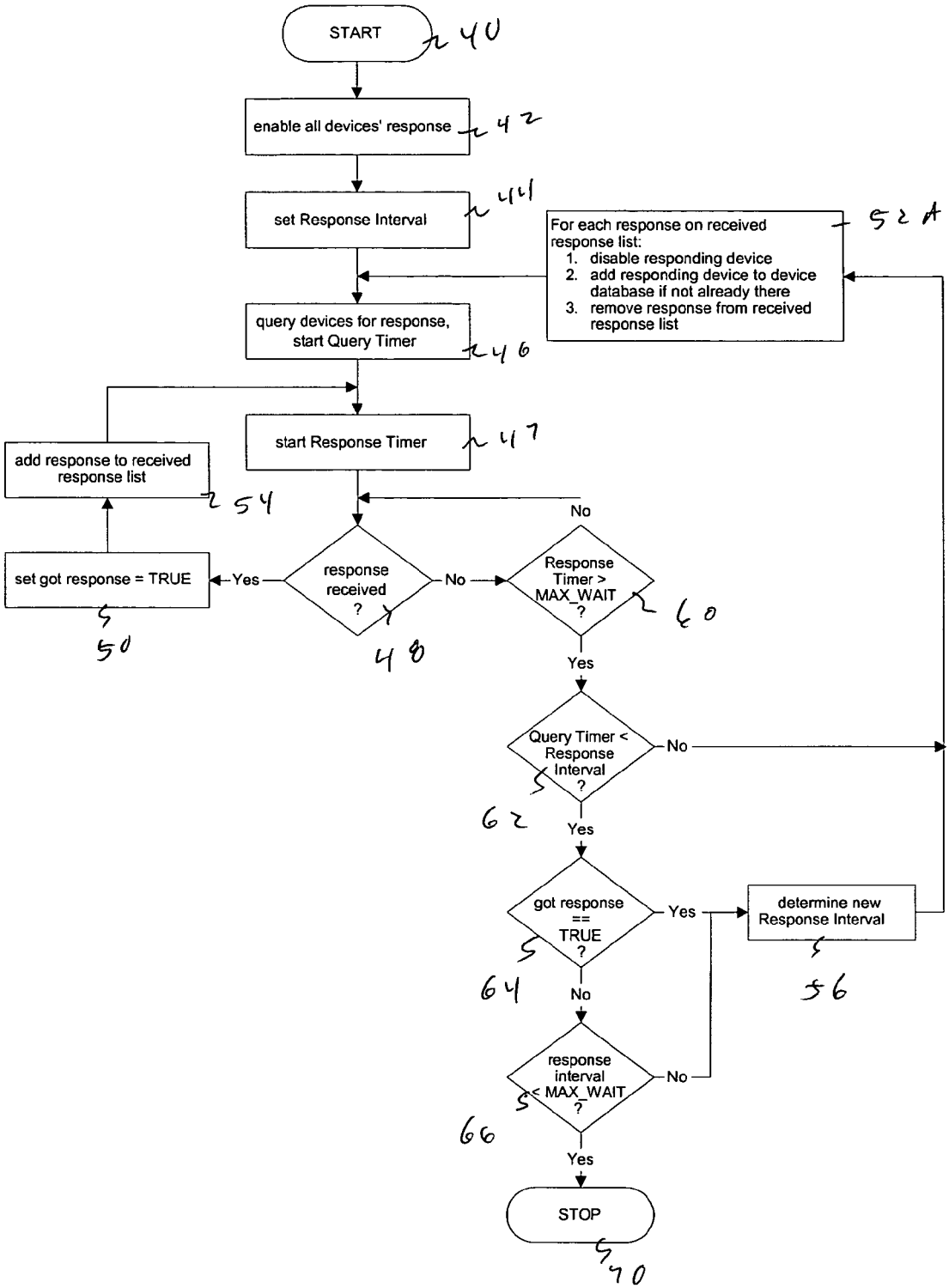
FIG. 6 is a flow chart showing a modification of the method of FIG. 5 according to the principles of the present invention.

A further embodiment is show in FIG. 6. The major difference between the embodiment of FIG. 5 and the embodiment of FIG. 6 is the start response timer at 47 and the determination of whether the maximum wait period between responses has expired at 60. This allows disabling the responding devices or nodes and/or changing the response interval duration before or after the expiration of the response interval based on capacity in the present response interval.

The start response timer 47 is restarted every time a response is received. If there is a determination that a response has been received at 48 YES, then it loops back through 50 and 54 to re-initiate the response timer 47. If a response has not been received at 48 NO, then there is a determination at 60 of whether the response timer has exceeded the maximum wait time or, in other words, the wait time between responses has expired. If not NO, the response timer 47 is not re-initiated, and the system cycles back to the determination at 48 of whether a response has been received.

When no response has been received within the wait period YES at 60, the process continues to determine if the response interval is greater than the query timer at 62. If NO, the devices are disabled at 52 using the remainder or pause in the response interval. If YES and the last response was TRUE-YES at 64, a new response interval may be set at 56 and the responding devices disabled at 52A. Thus, the determination of whether a new response interval is needed at 60 may be after both the wait period and the response interval have expired through 60 and 62. If the last response was not True-NO at 64, a determination is made at 66 of whether the response interval is less than the wait period. If No at 66, this is not the last cycle and the response interval is set to be less than the wait period at 56 and the devices are disabled at 52A. In the net pass through the process the determination at 66 will be YES and the process will end at 70.

For example, it has been found that approximately one-second is an appropriate wait period, but this may be in the range of one to five seconds.

Figure 7:
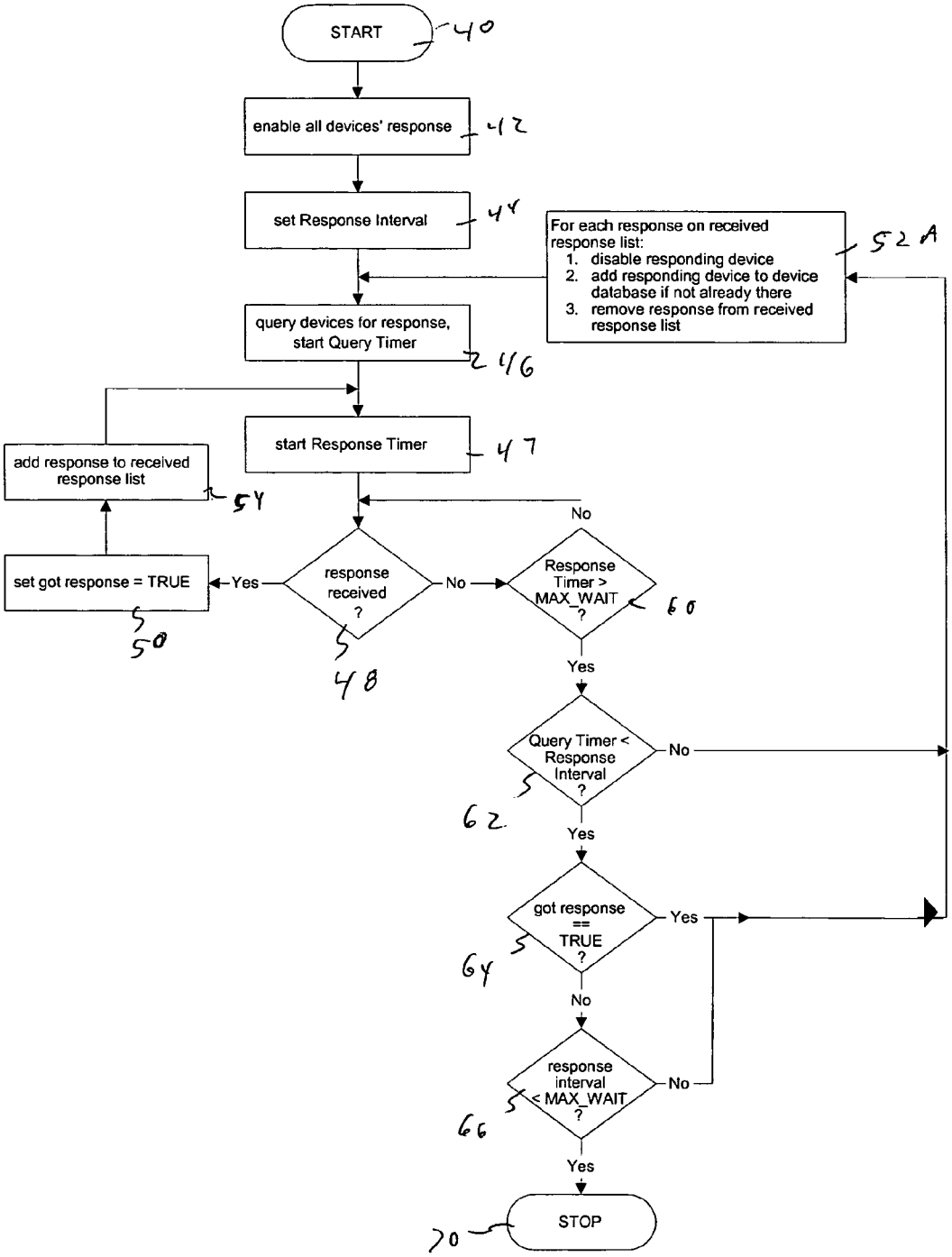
FIG. 7 is a flow chart showing a modification of the method of FIGS. 3 and 6 according to the principles of the present invention.

The embodiment of FIG. 7 is similar to that of FIG. 6 in that it takes advantage of the unused portion or portions of the response interval without modifying the length or duration of the response interval at 56.

In that standard S-4230 requires that the last query suspends all previous queries, sending out a new query in the middle of the present query could have two effects. If the new interval time of the query is greater than the remaining time on the present interval, it will have the effect of extending the present interval to handle more than the present interval. If the new response interval is less than the present response interval minus the length of time of the present interval to date, then the present interval has effectively been shortened. If the present interval time has expired, then the new interval rate can be shortened or lengthened to handle the appropriate capacity. Where a subsequent query is sent out before the present interval expires, all enabled nodes will determine the new response time based on the latest or subsequent query interval.

For the previous example, where it was anticipated that there would be 500 nodes responding at ten responses per second and the interval is set at 50 seconds. If over a ten-second period only 20 devices have responded instead of the anticipated 50, the interval may be shortened. If 70 devices have responded in this ten-second period, the interval may be extended. Again, this determination may be made over a portion of the present response interval with an estimation of the use during the total response interval, or the determination of use may be made at the end of the response interval.

Another way of controlling the response interval is estimating the number of active nodes or devices that have not responded in the response interval and setting the length of the subsequent response interval as a function of the number of active nodes that have not responded. Thus, in the previous example, if there was an estimation of 500 active nodes and 300 have responded, then there is an assumption that 200 remained, and an appropriate interval length would be set. Using the same ten responses per second would set an interval length of 30 seconds. Determining what the response is in the second interval would indicate the accuracy of the assumption. Also, the rate of response may be determined over a portion of the response interval. This information can also be used. In the previous example, ten responses per second may not be an accurate response rate and, therefore, it would have to be adjusted either with the estimated number of the remaining devices or by setting the new response interval.

The response interval may be incrementally decreased. The increments may vary in length. For example, using the previous example, the increments may be 50, 25, 12 . . . down to zero seconds. Another method of determining the appropriate interval time is a function of the ratio of the estimated number of active devices that have not responded after the present cycle to the estimated number of devices before the present cycle. For example, if there is an anticipation of 500 nodes at the beginning of the present cycle and 300 have responded, then the present interval would be reduced to 200 divided by 500 or, equivalently, to 40 percent. Thus, if the previous cycle was, for example, 50 seconds, it would now be 20 seconds. Another method would be using a look-up table. The indices of the look-up table may be the number of responses received in the period, the number of anticipated devices remaining or any other indicia, and the output would be in an appropriate response interval length. There may be a two-indices table with the number of devices as one index and the response rate as another index.

Other methods of determining the appropriate interval may be used. It is important that the interval rate be adjusted so as to not monopolize or inefficiently use the available communication bandwidth. In a 100-car train, there may be a minimum 100 CCDs. This must be added to the number of locomotives with active devices, as well as power sources, distributed throughout the train. The time required to locate and identify the devices or active nodes must be performed before sequencing or any of the other tests prior to moving the train. Thus, it is important that the time taken to locate and identify the devices is kept to a minimum.

| 4.2.1 Device Info Control/Query (0,3) | |
|---|---|
| Source: | HEU Lead |
| Dest: | HEU Trail, CCD, PSC, EOT |
| Msg Type: | Explicit |
| Msg Code: | 0x00 |
| Priority: | No |
| Message Rate: | As Needed |
| Service Type: | UNACKD or ACKD |

-continued

| 4.2.1 Device Info Control/Query (0,3) | |
|---|---|
| Addressing: | BCAST or UNICAST |
| Data Size: | 4 bytes |
| Description: | This message is used for controlling and requesting transmission of device info during train make-up. |

| Field Name | Size | Value/Range (Resolution) | Default | Notes |
|---|---|---|---|---|
| MSG ID NUMBER | 1 | 3 Only | 3 | |
| MSG VERSION | 1 | 0 to 255 | 1 | |
| COMMAND | 1 | Bit 0–1: 0 = UNLOCK<br>1 = LOCK<br>2 = SEND Device Info<br>3 = Not Used | | A. |
| | | Bits 2–4: Device Type<br>Bits 5–7: Not Used (set to 0) | | B. |
| RANDOMIZING INTERVAL | 1 | 0 to 254 seconds (LSB = 1 sec) | 0 | C. |

Notes:
A. After a LOCK is received, the device will no longer respond to SEND Device Info Queries until an UNLOCK command is received or the device resets. Devices shall default to UNLOCKED at power up or after a reset.
B. Device type is as defined in section Error! Reference source not found. A device type of 0 indicates all devices.
C. This field indicates the time period over which responding network devices are to randomize their responses to this message when broadcast addressing is used. The responding network devices shall randomize their responses in increments of 50 milliseconds over the specified randomizing interval. For unicast messages, this field shall be set to 0. For unicast messages, the destination address for this message shall be a Unique ID. If a device receives this message while waiting to respond to a prior message, it shall respond only to the latest message.

Although the present invention has been described and illustrated in detail, it is to be clearly understood that the same is by way of illustration and example only, and is not to be taken by way of limitation. The scope of the present invention is to be limited only by the terms of the appended claims.

What is claimed is:

1. A method of locating nodes in a train having a plurality of cars and at least one node per car, the method comprising:

enabling each node;

querying each enabled node to respond during a response interval;

disabling each node which responded;

determining the number of responses during a present response interval;

setting the length of a subsequent response interval as a function of the determined number of responses; and re-querying the enabled nodes until no further responses are received during a response interval.

2. The method according to claim 1, wherein the number of responses is determined for a portion of the present response interval, and the length of the subsequent response interval is set based on the response rate determined for the portion of the present response interval.

3. The method according to claim 2, wherein the subsequent response interval is initiated before the expiration of the present response interval if a new interval length is to be set.

4. The method according to claim 3, wherein the present response interval is effectively extended by setting a subsequent response interval length to the same or greater length than the present interval length.

5. The method according to claim 3, wherein the present interval length is effectively decreased by setting a subsequent interval length to less than the present interval's length minus the length of the portion of the present response interval used to determine and set the subsequent interval length.

6. The method according to claim 1, including determining if a response has not been received before expiration of a wait period between responses and performing the determining number of responses and setting the interval length if it has been determined that a response has not been received before the wait period has expired.

7. The method according to claim 6, wherein the setting of the interval length is perform after expiration of both the wait period and the response interval.

8. The method according to claim 6, wherein the disabling is performed after the expiration of both the wait period and the response interval.

9. The method according to claim 6, wherein the disabling is performed after the expiration of the wait period.

10. The method according to claim 6, wherein the length of the response interval is incrementally decreased until the wait period has not expired before the response interval has expired.

11. The method according to claim 10, wherein the increments are of variable lengths.

12. The method according to claim 1, wherein the disabling is performed after the expiration of the response interval.

13. The method according to claim 1, wherein the disabling is performed before the expiration of the response interval.

14. The method according to claim 1, wherein an initial interval length is set based on anticipated number of active nodes and anticipated response rate.

15. The method according to claim 1, including estimating the number of active nodes that have not responded and setting the length of the subsequent response interval as a function of the number of active nodes that have not responded.

16. The method according to claim 15, including determining a rate of response and wherein the length of the subsequent response interval is set as a function of both the number of active nodes that have not responded and the determined response rate.

17. The method according to claim 15, wherein the subsequent interval length is set as a function of the ratio of the estimated number of active nodes that have not responded after the present interval to the estimated number before the present interval.

18. The method according to claim 1, wherein setting the interval length includes using the determined number of responses as an index of a look-up table of response interval lengths.

19. The method according to claim 1, wherein the length of the response interval is incrementally decreased.

20. The method according to claim 19, wherein the increments are of variable lengths.

21. A method of locating nodes in a train having a plurality of cars and at least one node per car, the method comprising:

enabling each node;

simultaneously querying each enabled node to respond during a response interval;

disabling each node which responded after expiration of the response interval; and simultaneously re-querying the enabled nodes during subsequent response intervals until no further responses are received during a response interval.

22. The method according to claim 21, including determining the number of responses during a present response interval; and setting the length of a subsequent response interval as a function of the determined number of responses.

23. A method of locating nodes in a train having a plurality of cars and at least one node per car, the method comprising:

enabling each node;

simultaneously querying each enabled node to respond during a response interval;

determining if a response has not been received before expiration of a wait period between responses;

disabling each node which responded before expiration of the response interval if it has been determined that a response has not been received before the wait period has expired; and simultaneously re-querying the enabled nodes during subsequent response intervals until no further responses are received during a response interval.

24. The method according to claim 23, including determining the number of responses during a present response interval; and setting the length of a subsequent response interval as a function of the determined number of responses.

* * * * *